US008388766B2

(12) United States Patent
Ohashi

(10) Patent No.: US 8,388,766 B2
(45) Date of Patent: Mar. 5, 2013

(54) ANISOTROPIC RARE EARTH SINTERED MAGNET AND MAKING METHOD

(75) Inventor: Ken Ohashi, Tokyo (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 0 days.

(21) Appl. No.: 13/279,591

(22) Filed: Oct. 24, 2011

(65) Prior Publication Data

US 2012/0105184 A1 May 3, 2012

(30) Foreign Application Priority Data

Oct. 29, 2010 (JP) ..... 2010-243417

(51) Int. Cl.
*H01F 1/057* (2006.01)

(52) U.S. Cl. ..... 148/103; 148/302; 148/101

(58) Field of Classification Search ..... None
See application file for complete search history.

(56) References Cited

U.S. PATENT DOCUMENTS

| | | | | |
|---|---|---|---|---|
| 4,770,723 | A * | 9/1988 | Sagawa et al. | 148/302 |
| 4,792,368 | A * | 12/1988 | Sagawa et al. | 148/302 |
| 4,919,732 | A * | 4/1990 | Yang et al. | 148/103 |
| 5,766,372 | A | 6/1998 | Fujimura et al. | |
| 6,187,259 | B1 | 2/2001 | Yamashita et al. | |
| 6,741,002 | B2 | 5/2004 | Nishiyama et al. | |
| 7,416,613 | B2 * | 8/2008 | Chou et al. | 148/103 |
| 7,824,506 | B2 | 11/2010 | Machida et al. | |
| 2003/0209842 | A1 * | 11/2003 | Okumura et al. | 266/249 |
| 2008/0066575 | A1 * | 3/2008 | Yang | 75/229 |
| 2008/0101979 | A1 | 5/2008 | Kato et al. | |

FOREIGN PATENT DOCUMENTS

| | | | |
|---|---|---|---|
| EP | 1793393 | A1 | 6/2007 |
| EP | 1921638 | A2 | 5/2008 |
| EP | 2028663 | A1 | 2/2009 |
| JP | 59-046008 | A | 3/1984 |
| JP | 60-088418 | A | 5/1985 |
| JP | 2000-245085 | A | 9/2000 |
| JP | 2003-053596 | A | 2/2003 |
| JP | 2006-264316 | A | 10/2006 |
| JP | 2008-133166 | A | 6/2008 |
| WO | 2006/064848 | A1 | 6/2006 |

OTHER PUBLICATIONS

Machine Translation of JP 2003-53596, Feb. 26, 2003.*
Patent Abstracts of Japan, 2006-264316, Oct. 5, 2006.*
European Office Action dated Dec. 6, 2011, issued in corresponding European Patent Application No. 11187039.0.

* cited by examiner

*Primary Examiner* — John Sheehan
(74) *Attorney, Agent, or Firm* — Westerman, Hattori, Daniels & Adrian, LLP

(57) ABSTRACT

An anisotropic rare earth sintered magnet has a tetragonal $R_2Fe_{14}B$ compound as a major magnetic phase, wherein R is Nd or a mixture of Nd with at least one rare earth element. Grains of the compound phase have two crystallographic axes, c and a-axes aligned. The biaxially aligned magnet exhibits a coercivity Hc of at least 1.6 MA/m.

8 Claims, 4 Drawing Sheets

NUCLEATION GROWTH MODE

DOMAIN WALL PINNING MODE

INVENTIVE PROCESS

PRIOR ART PROCESS

ANISOTROPIC RARE EARTH SINTERED MAGNET AND MAKING METHOD

CROSS-REFERENCE TO RELATED APPLICATION

This non-provisional application claims priority under 35 U.S.C. §119(a) on Patent Application No. 2010-243417 filed in Japan on Oct. 29, 2010, the entire contents of which are hereby incorporated by reference.

TECHNICAL FIELD

This invention relates to anisotropic rare earth sintered magnets for use in motors and the like, and a method for preparing the same.

BACKGROUND ART

Since the discovery in 1982 (JP-A S59-46008), NdFeB magnets comprising tetragonal $Nd_2Fe_{14}B$ compound as major phase (simply referred to as Nd magnets) have been used in a wide variety of applications. Nowadays, they are useful materials in the manufacture of electronic/electric, transportation and industrial equipment. Despite some drawbacks including relatively low Curie temperature (~310° C.) and poor corrosion resistance, the Nd magnets have advantages including high saturation magnetization at room temperature, relatively inexpensive constituents, relatively high mechanical strength. The Nd magnets surpass the prior art 2-17 SmCo magnets and find ever increasing application fields. Among others, their application as vehicle-mounted components including motors for electric vehicles (EV) and hybrid electric vehicles (HEV) and power generators is considered most promising (JP-A 2000-245085).

Vehicle-mounted components are typically used in an environment in excess of 100° C. In the case of EV and HEV motors, heat resistance at temperatures above 150° C., and sometimes around 200° C. is required. Nevertheless, because of relatively low Curie temperature (~310° C.), the $Nd_2Fe_{14}B$ compound undergoes a substantial decline of coercivity at high temperature (typically a temperature coefficient of Hc of about −0.6%/° C.). It is difficult to use low-Hc magnets in the temperature range in excess of 100° C. As used herein, the term "coercivity" refers to coercivity Hcj of a M-H curve, often abbreviated as Hc.

The most desirable solution to this problem is to improve the temperature coefficient of coercivity. However, an essential improvement is difficult since this solution is based on magnetocrystalline anisotropy constant and Curie point which are inherent physical properties of the magnetic $Nd_2Fe_{14}B$ compound. The second best improvement is to substitute a heavy rare earth element Dy or Tb for part of Nd to improve the anisotropy field (sometimes referred to as Ha) for thereby increasing the coercivity Hc at room temperature. The high coercivity Hc at room temperature ensures that even when a decline of Hc occurs upon exposure to a high temperature, a Hc level for the intended use at the temperature is maintained. Not only substitution of Dy/Tb for Nd sites, but also substitution of Al, Cu, Ga, Zr or the like for Fe sites is effective for Hc improvement. However, the Hc enhancing effect by such substitution is limitative. The element that achieves a Hc enhancing effect in proportion to the substitution quantity is limited to heavy rare earth elements Dy and Tb.

As discussed above, the substitution of heavy rare earth elements Dy and Tb is very effective for Hc enhancement.

However, since Nd and Dy/Tb produce magnetic moments in inverse directions, the saturation magnetization (sometimes referred to as Ms) decreases in proportion to the substitution quantity. Since a decrease of Ms occurs in exchange for an enhancement of Hc, the maximum energy product (sometimes referred to as (BH)max) decreases in proportion to the squares of Ms (i.e., $Ms^2$). That is to say, heat resistance is acquired at the sacrifice of Ms. In addition, Dy and Tb have low Clarke numbers, indicating that their resource amount is only a fraction of Nd, and are rarer than Nd. As a matter of course, the prices of Dy and Tb minerals are several times to ten times higher than that of Nd. The occurrence of these minerals is extremely biased to one country. From both the aspects of price and resource, the use of Dy and Tb becomes a neck for the Nd magnet manufacture from now on.

It is desirable to enhance the Hc of Nd magnets without substitution or addition of Dy and Tb, so that the Nd magnets may be used in a high-temperature environment above 100° C. The development effort capable of achieving this goal is important. Great investigations were made from both the composition and process sides, including substituting elements other than the above-listed Al, Cu and Ga, low-oxygen process, sintered structure grain refinement, and the like, and are now still continued. So far, the removal of Dy/Tb in magnet composition is not prospected, but a saving of Dy/Tb has been attempted by several proposals, some of which are approaching the practical level (WO 2006/64848).

With respect to the Dy/Tb saving, several different proposals are known, but they are common in that after preparation and machining of a sintered body, Dy/Tb is diffused and infiltrated into the body from the surface along grain boundaries. The resulting sintered magnet has the structure that Dy or Tb is localized only at and near major phase grain boundaries in a high concentration, and the concentration of Dy or Tb gradually decreases from the surface toward the magnet interior. Such a non-equilibrium structure is effective for Hc enhancement, because the coercivity mechanism of Nd magnet is of nucleation growth mode so that Hc is governed by the near grain boundary structure morphology and composition of the major phase (R is at least one rare earth element including essentially Nd, simply referred to as 2-14-1, hereinafter). Although any quantitative discussion on the nucleation growth mechanism is still impossible, it is true that Hc can be enhanced by magnetically strengthening only the near grain boundary structure with Dy or Tb. In addition, since these elements are localized only near grain boundaries, a decrease of saturation magnetization Ms is quite small as compared with the substitution of the overall alloy. The grain boundary localizing process reduces the amount of Dy or Tb used to acquire an identical Hc, to or below half of the amount of Dy or Tb used in the prior art for the substitution of the overall alloy during melting.

As described above, the Dy or Tb grain boundary localizing process is very advantageous from both the aspects of resource saving and magnetic enhancement. However, the process has some problems which are not critical, but too serious to be overlooked. One problem is that magnet machining must be followed by the extra step of diffusion or reprocessing for Hc enhancement. The increased number of steps, of course, increases the process expense. Since Dy/Tb diffuses from the magnet surface toward the interior along grain boundaries, a differential concentration of the element arises between the surface and the interior, resulting in a distribution of Hc within the magnet dependent on the distribution of the element. If the magnet thickness exceeds 10 millimeters (mm), for example, there is a possibility that the amount of Dy/Tb is zero at the center of the magnet. If the temperature and time of diffusion treatment are increased in order to flatten the concentration distribution between the surface and the interior, diffusion takes place deeper into the magnet interior, but the tendency of Dy/Tb diffusing from the grain boundary into the interior of major phase 2-14-1 grains becomes outstanding. This results in the same state as the addition of Dy/Tb during alloy preparation. For this reason, the thickness of a magnet to which the diffusion treatment is effectively applicable is at most several millimeters (mm). It is sometimes believed that in the case of motors and power generators, the enhancement of Hc only near the magnet surface where eddy current flows to generate an outstanding amount of heat is satisfactory. It depends on the use and quantity of Nd magnets from now on whether or not the distribution of He within the magnet becomes a rate determining factor in the magnet application.

Essentially desired is the removal of Dy/Tb. The $Nd_2Fe_{14}B$ compound has an anisotropy field Ha (theoretical maximum coercivity) of about 6.4 MA/m (80 kOe). In contrast, sintered magnets of Dy/Tb-free Nd base composition have a He of about 0.8 MA/m at most. That is, only a He corresponding to about ⅛ of the theory is obtained. The qualitative description of He of Nd magnet is that the most disordered region (defect, transition, non-smooth surface, etc.) near boundaries of sintered major phase grains with a size of several microns (μm) to 10 μm becomes a bud of a reverse magnetic domain upon application of a reverse magnetic field, and magnetization inversion originates therefrom. It is true that the near grain boundary structure morphology of the major phase is related to Hc, but it is not evident what region or what component of the structure is a rate-determining factor of actual Hc, despite a vast amount of observations and investigations made thus far. Of course, at the present, investigations are concentrated on the control of grain boundaries and neighbors thereof, in order to clarify the He rate-determining factor. The difficulty of this measurement/analysis problem resides in the fact that a nanometer-order portion near the surface of grains with a micrometer-order size is a rate-determining factor to Hc, analysis must be made over the entire surface of a size of more than 1,000 times before the magnetically weakest portion becoming the He rate determining factor can be identified. There is available no method capable of analyzing on the nanometer order the entire three-dimensional surfaces of a sintered particle with a size of the micrometer order.

However, it is readily presumed from the results of the grain boundary localization method mentioned above that He is improved by tailoring the structure and composition near the surface of Nd magnet grains. For example, if a He of 1.6 MA/m which is approximately ¼ of the theoretical Ha is obtained, the majority of Nd magnet applications is covered. If a Hc of 2.1 MA/m which is ⅓ of the theoretical Ha is obtained, Dy/Tb addition is unnecessary except special applications. The current demand is exclusion of Dy/Tb rather than a saving of Dy/Tb.

CITATION LIST

Patent Document 1: JP-A S59-46008
Patent Document 2: JP-A 2000-245085
Patent Document 3: WO 2006/64848
Patent Document 4: JP-A 2006-264316
Patent Document 5: JP-A 2008-133166 (EP 1921638, US 20080101979)

SUMMARY OF INVENTION

An object of the invention is to provide an anisotropic rare earth sintered magnet that produces a coercivity in excess of 1.6 MA/m, without a need for heavy rare earth elements Dy and Tb and without limitation of shape and the like; and a method for preparing the same.

The coercivity mechanism of an Nd magnet is classified into the nucleation/growth mode as previously mentioned. FIG. 1 shows how the coercivity mechanism of a permanent magnet is classified in terms of an initial magnetization curve. An Nd magnet having an initial magnetization curve as shown in FIG. 1A is classified into the nucleation/growth mode, a quantitative discussion of which is not evident as previously pointed out. A 2-17 SmCo magnet having an initial magnetization curve as shown in FIG. 1B is classified into the domain wall pinning mode. FIG. 2 is a TEM photomicrograph of an Nd sintered magnet near major phase grain boundaries. Qualitatively stated, it is believed desirable that the morphology of outermost layer portions of 2-14-1 major phase 2A, 2B, and 2C in close contact with grain boundary phases 1A and 1B is a structure which is as smooth as possible and least defective. This is because the coercivity of an Nd magnet is determined by the structural morphology of major phase outermost layer portion as previously mentioned. However, in the actual manufacture of Nd magnet by powder metallurgy, it was impossible to intentionally control the structural morphology of major phase outermost layer. Consequently, only a coercivity Hc which is less than a fraction of the anisotropy field Ha or the theoretical coercivity was available. It is noted that a ZrB precipitated phase is depicted at 3 in FIG. 2.

The invention attempts to enhance the coercivity Hc of a NdFeB magnet (Nd magnet) to a level of around 1.6 MA/m, without addition of Dy and Tb, by intentionally establishing a smoother, less defective state of major phase outermost layer than in the prior art. Of course, Dy and/or Tb may be used herein. When Dy and/or Tb is added, a necessary Hc is obtainable with a smaller amount than in the prior art. In this sense, the invention does not exclude the addition of Dy and Tb.

The inventor has found that by controlling the alignments of two axes of an Nd magnet, c-axis which is an axis of easy magnetization and a-axis which is an axis of hard magnetization, the major phase outermost layer can be endowed with a smoother, less defective state. This improves matching between sintered grains and establishes a smoother, less defective grain boundary neighbor structure than in the prior art. Consequently, an Nd magnet with a Hc of at least 1.6 MA/m can be produced without addition of Dy and Tb.

In one aspect, the invention provides an anisotropic rare earth sintered magnet comprising a tetragonal $R_2Fe_{14}B$ compound as a major magnetic phase, wherein R is at least one rare earth element essentially including Nd, compound phase grains having two crystallographic axes, c and a-axes aligned.

In a preferred embodiment, the magnet has a composition consisting essentially of R-R'-T-M-B and incidental impurities wherein R is a rare earth element which is Nd or a combination of Nd with at least one member selected from the group consisting of Y, La, Ce, Pr, Sm, Eu, Gd, Ho, Er, Tm, Yb, and Lu, R' is Dy and/or Tb, T is Fe or Fe and Co, M is at least one element selected from the group consisting of Ti, Nb, Al, V, Mn, Sn, Ca, Mg, Pb, Sb, Zn, Si, Zr, Cr, Ni, Cu, Ga, Mo, W, and Ta, and the contents of these elements are 10 at %≦R≦20 at %, 0 at %≦R'≦5 at %, 0 at %≦M≦15 at %, 3 at %≦B≦15 at %, with the balance of T.

More preferably, the composition contains a rare earth element R which is Nd or a combination of Nd with at least one member selected from the group consisting of Y, La, Ce, Pr, Sm, Eu, Gd, Ho, Er, Tm, Yb, and Lu, and is free of Dy and Tb, and the magnet has a coercivity Hcj of at least 1.6 MA/m.

In another aspect, the invention provides a method for preparing an anisotropic rare earth sintered magnet comprising a tetragonal $R_2Fe_{14}B$ compound as a major magnetic phase, wherein R is at least one rare earth element essentially including Nd, the method comprising the steps of providing a magnet powder comprising a tetragonal $R_2Fe_{14}B$ compound as a major magnetic phase, compound phase grains having two crystallographic axes, c-axis as axis of easy magnetization and a-axis as axis of hard magnetization; compacting the powder while a first magnetic field is applied across the powder so as to align the c-axis in the magnetic field direction, and a second magnetic field substantially orthogonal to the first magnetic field is applied to align the a-axis; and sintering the resulting compact to form a sintered magnet in which c- and a-axes are aligned.

Preferably, the first magnetic field is a static magnetic field and the second magnetic field is a pulsed magnetic field.

The preferred embodiments of the magnet composition are also applicable to the method.

ADVANTAGEOUS EFFECTS OF INVENTION

By controlling the alignments of two axes of major phase grains of a Nd magnet powder, c-axis which is an axis of easy magnetization and a-axis which is an axis of hard magnetization upon magnetic field application in the step of in-magnetic-field pressing, a sintered body having two axes aligned can be produced. It is believed that since two axes, c and a-axes of sintered grains are aligned, the grains are smoothly tied via a non-magnetic grain boundary phase, whereby the grain boundary neighbor morphology is smoothened. As a result, a Hc of at least 1.6 MA/m can be established without addition of Dy and/or Tb.

DESCRIPTION OF EMBODIMENTS

Figure 1A:
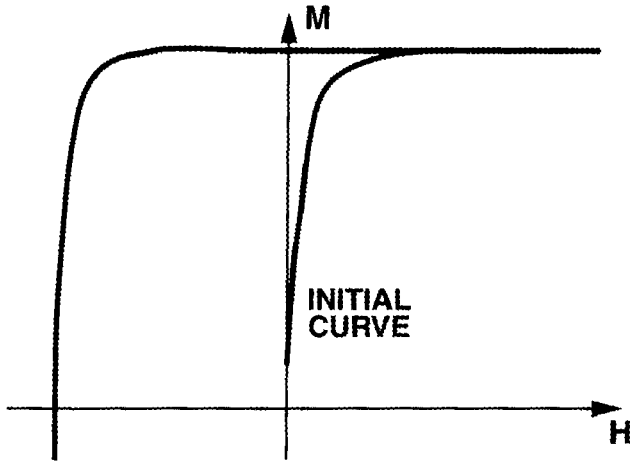
FIG. 1 graphically illustrates an initial magnetization curve, FIG. 1A showing the coercivity mechanism of nucleation growth mode and FIG. 1B showing the coercivity mechanism of domain wall pinning mode.
Figure 1B:
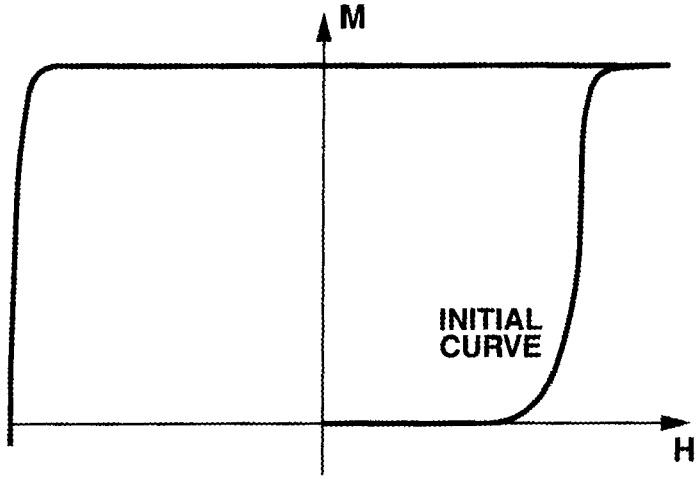
Figure 2:
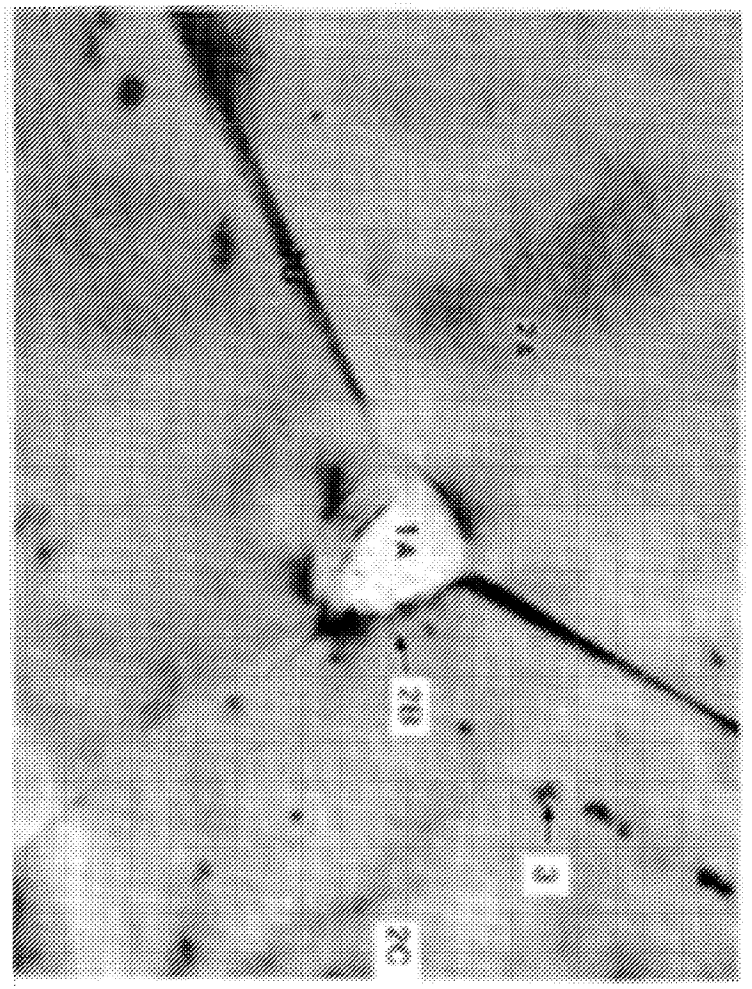
FIG. 2 is a TEM micrograph of a NdFeB sintered magnet, showing its crystalline structure.
Figure 3A:
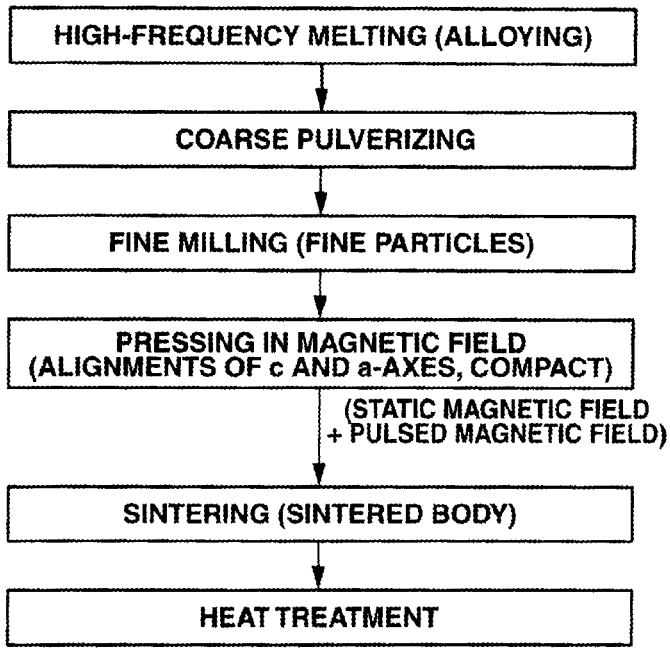
FIG. 3 illustrates a process of preparing a rare earth sintered magnet by powder metallurgy, FIG. 3A being the inventive process and FIG. 3B being the prior art process.
Figure 3B:
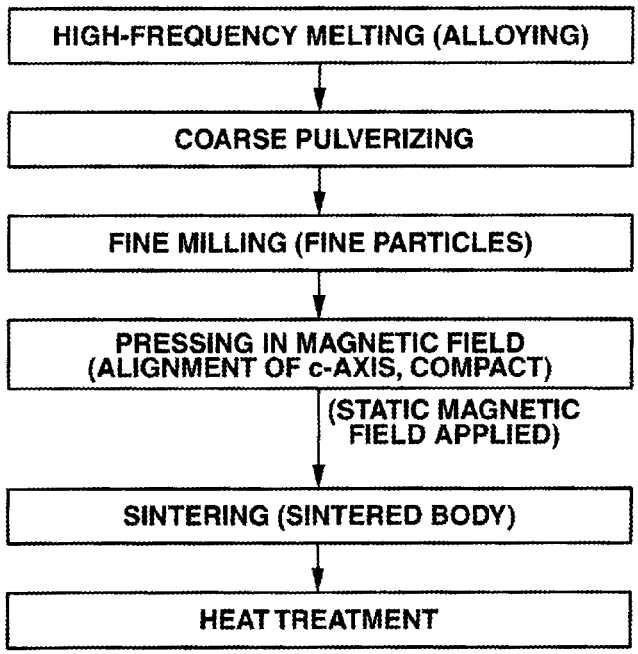

FIG. 3A illustrates a process of preparing a rare earth sintered magnet according to one embodiment of the invention. FIG. 3B illustrates a magnet preparation process by the general powder magnetic field orientation method. First, the magnet composition used in the invention may be in the commonly well-known range, specifically a R-R'-T-M-B composition wherein R is a rare earth element which is Nd or a combination of Nd with at least one member selected from the group consisting of Y, La, Ce, Pr, Sm, Eu, Gd, Ho, Er, Tm, Yb, and Lu, R' is Dy and/or Tb, T is Fe or Fe and Co, M is at least one element selected from the group consisting of Ti, Nb, Al, V, Mn, Sn, Ca, Mg, Pb, Sb, Zn, Si, Zr, Cr, Ni, Cu, Ga, Mo, W, and Ta, and the contents of these elements are 10 at %≦R≦20 at %, 0 at %≦R'≦5 at %, 0 at %≦M≦15 at %, 3 at %≦B≦15 at %, with the balance of T. The composition may contain incidental impurities. Desirably R contains at least 50 at %, more desirably 90 to 100 at % of Nd. The more preferred range is 12 at %≦R≦16 at %, 0 at %≦R'≦3 at %, 0.005 at %≦M≦1 at %, and 5.5 at %≦B≦8.5 at %. Most preferred is a compound free of R' (Dy and/or Tb) and having the major magnetic phase of $R_2Fe_{14}B$ wherein R is as defined above.

Using constituents containing the aforementioned elements, an alloy having a composition within the aforementioned range is prepared by any conventional methods such as powder metallurgy and strip casting. The alloy is coarsely crushed on a jaw crusher or Brown mill or by hydrogen decrepitation, and finely milled on a ball mill or jet mill, obtaining a NdFeB fine powder consisting of particles with a size of the order of single crystal size (average particle size 2 to 8 μm, simply referred to as "Nd fine powder"). The Nd fine powder is subjected to the aligning and pressing step characteristic of the invention wherein c-axis is aligned in one magnetic field direction and a magnetic field is oriented in a-axis which is perpendicular to c-axis. The powder is thus shaped under pressure into a green compact.

The compact is then sintered in vacuum or an inert gas at a temperature of 1,000 to 1,200° C., typically around 1,100° C. for 0.5 to 5 hours, obtaining a high density sintered body. After sintering or consecutively to sintering, heat treatment is carried out in an inert gas atmosphere (e.g., nitrogen or argon) at an appropriate temperature below the sintering temperature, specifically 300 to 600° C., typically around 500° C., for 0.5 to 5 hours, for improving Hc. The sintered body is machined and magnetized, obtaining a magnet in which the magnetic flux emerges from the oriented C-plane. In almost all magnet applications, the magnetic flux from the C-plane is utilized. A plane perpendicular thereto, which is a hard axis direction, is not utilized in practice. Therefore, the necessity to control the direction of hard axis is not recognized at all in the art. The inventor has discovered that biaxial alignments are effective for improving matching between sintered grains, smoothening the grain boundary neighbor structure, and enhancing Hc.

Since the $Nd_2Fe_{14}B$ phase as the major phase of an Nd magnet has a tetragonal structure, controlling the alignments of two crystal axes, a-axis and c-axis perpendicular thereto is identical with the alignments of three axes. In the biaxially aligned magnet in which not only c-axis direction, but also a-axis are aligned, the crystallographic matching between sintered grains is significantly improved. Single crystal grains with a size of about 4 to 5 μm are bulked via the non-magnetic phase (grain boundary phase) to form a pseudo-monocrystalline sintered body. With the aid of the R-rich non-magnetic grain boundary phase, the major phase boundary becomes smoothened or flattened. Such a smooth interface effectively works to enhance coercivity Hc as will be described later. This is deduced from the result of Hc enhancement because the quantitative relationship of Hc enhancement to grain interface is not definitely determined as discussed in the background section.

The alignments of two axes, c and a-axes imply the presence of both c-axis aligned domains and a-axis aligned domains.

It is now described how to apply magnetic fields according to the invention. In the magnetic field aligning step, not only c-axis which is an axis of easy magnetization of 2-14-1 major phase, but also a-axis which is an axis of hard magnetization are aligned. One exemplary method of aligning two or more axes is by applying a rotating magnetic field to a non-magnetic ceramic powder (Patent Document 4). This method utilizes the relaxation response to magnetic field that differs depending on a difference of magnetic susceptibility along axes. Generally, two or three axis alignments are achieved by dispersing fine particles in a solvent to form a slurry, and then simply applying a rotating magnetic field across the slurry, or changing the rotational speed of a rotating magnetic field in every axis direction so as to ensure magnetic field application within the alignment relaxation time.

However, the rotating magnetic field method is not applicable to magnet powders including Nd magnet powders. When a magnetic field is applied across a Nd magnet powder to magnetize particles in c-axis direction, N- and S-poles are attracted together to form a string of serially tied particles. In general, when one magnetized particle is taken out, the magnetostatic energy is increased, and so its state is metastable, but disadvantageous in energy. On the other hand, when magnetized particles are serially tied to form a string, the magnetostatic energy is drastically reduced, leading to a very stable state. This is because the demagnetizing field within the magnetic powder is significantly reduced. In the strung magnetic particle state, when the procedure of interrupting the initially applied static magnetic field and applying again a magnetic field in a different direction is taken, it is required that once the energy-stable strung state be cancelled, particles be re-tied into a string. That is, movement in a direction other than the direction of the initially applied static magnetic field is inhibited. Differently stated, a longer relaxation time is taken for rearrangement. On the other hand, in the Nd magnet powder, the magnetic susceptibility $\chi c$ in c-axis direction which is an axis of easy magnetization is extremely larger than $\chi a$ in a-axis direction which is an axis of hard magnetization, $\chi c >> \chi a$. Accordingly, the torque for orienting c-axis in the magnetic field direction is very high, and the relaxation time is short. The state of re-orientation is determined by a competition of these actions. In the Nd magnet powder, since the magnetization torque tending to orient the c-axis of easy magnetization in the magnetic field direction is high, the rotational speed of the rotating magnetic field must be increased, which is difficult to control. Consequently, the biaxial alignment by the prior art rotating magnetic field orientation method is less suited for magnet powder.

Figure 4A:
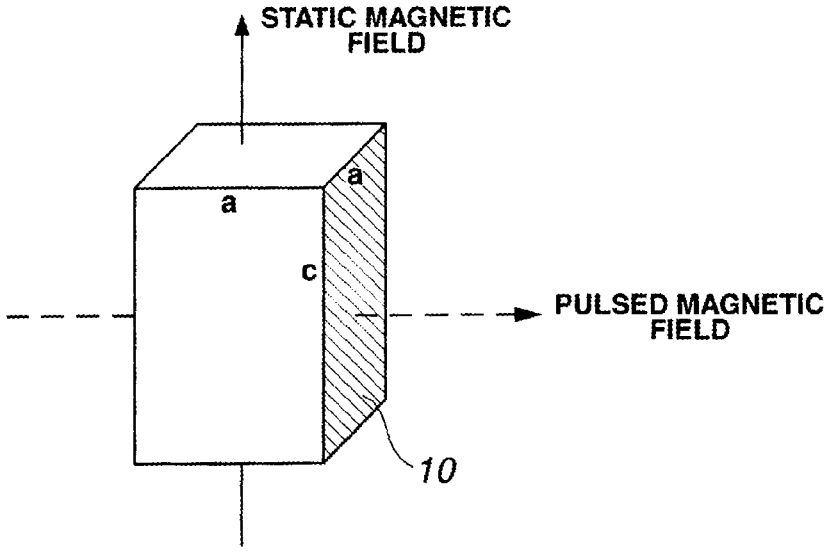
FIG. 4 is a schematic view of biaxial magnetic field alignment, FIG. 4A showing magnetic field applying directions and FIG. 4B showing the spinning state of a string of magnetic particles upon application of a pulsed magnetic field.
Figure 4B:
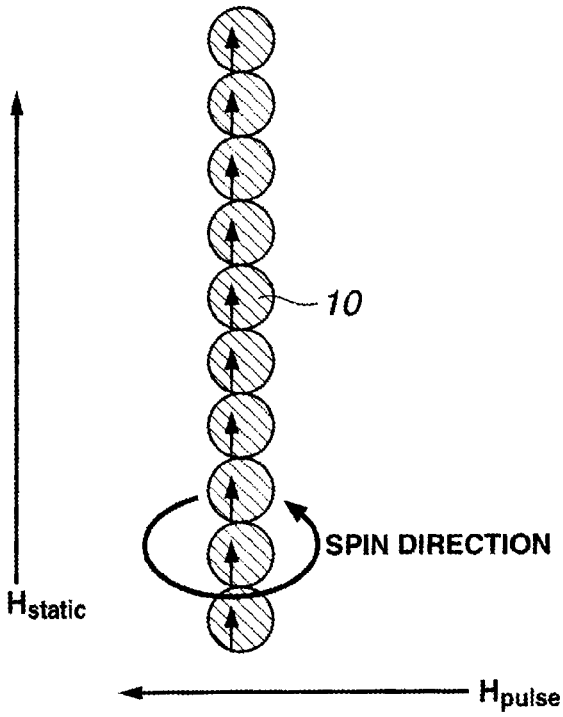

According to the invention, magnetic fields are applied along two axes of the major phase of a magnet alloy. First, as shown in FIG. 4A, a static magnetic field is applied across an Nd powder shape packed in a mold for thereby aligning c-axis of easy magnetization of magnetic particles 10 in the magnetic field direction. This magnetic field is applied so that alignment in c-axis direction may take place under a static magnetic field with a primary magnetic field strength of 0.5 to 5 T. With c-axis aligned, another magnetic field is overlappingly applied in a direction generally perpendicular to the static magnetic field (see FIG. 4A). The perpendicular magnetic field may be either a static magnetic field or a pulsed magnetic field, with the pulsed magnetic field being preferred from the standpoint of hard axis alignment. Even when the pulsed magnetic field is applied in a perpendicular direction, the aligned magnetic powder 10, which has formed a string of tied particles in the static magnetic field orientation state, undergoes little re-alignment in the resultant direction of both the magnetic fields (see FIG. 4B). This is because the relaxation time for re-alignment of strung magnetic particles is long and because the string of particles is fixed in the static magnetic field direction. Since the application time of the pulsed magnetic field is shorter than the relaxation time for re-alignment, re-alignment of strung magnetic particles in the resultant magnetic field direction does not take place. Nevertheless, rotation of individual magnetic particles in the perpendicular orientation plane is easy in the string-tied state. This is because rotation of individual magnetic particles causes little change to the magnetostatic energy of the strung state. Then, the overlapping application of pulsed magnetic field in the perpendicular direction allows for rotation of fine particles within C-plane of Nd magnet powder (i.e., a-axis alignment). That is, biaxial alignments of c- and a-axes are possible.

The static magnetic field and the pulsed magnetic field both preferably have a strength of 0.5 to 5 T, more preferably 1 to 5 T, and even more preferably 1 to 2.5 T (peak value in the case of pulsed magnetic field) although alignment can take place even at a strength lower than the range. If the peak value of the pulsed magnetic field for alignment in a-axis direction is less than 0.5 T, then the degree of a-axis alignment may gradually decrease. For the static magnetic field, the application time is preferably 0.5 to 180 seconds. The pulsed magnetic field may have a rise time of 100 μsec to 1 sec, especially 1 to 100 msec. A rise time of less than 100 μsec, in which rotation of magnetic particles can occur, is undesirable because the pulsed magnetic field hardly penetrates through the mold packed with the magnetic powder. The pulsed magnetic field may be applied in plural pulses for increasing the degree of alignment. However, since the electric charging operation is time consuming, the number of pulses may be determined from a tradeoff between productivity and degree of alignment. With respect to the timing of static magnetic field and pulsed magnetic field, it suffices that the static magnetic field precedes the pulsed magnetic field. It is acceptable to apply these magnetic fields substantially at the same time. Although it is possible to apply a static magnetic field in the perpendicular direction instead of the pulsed magnetic field, application of such magnetic field takes a longer time than the pulsed magnetic field and causes some influence in the c-axis alignment direction. For this reason, the pulsed magnetic field is more desirable. The duration of magnetic field applied may be selected in the range of 100 μsec to 1 sec, though not particularly limited. The number of pulses may be selected as appropriate in the range of 1 to 100, especially 1 to 20.

Biaxial alignment is followed by pressing, sintering, machining and coating steps as in the conventional powder sintering process, yielding a sintered magnet. The process is successful in producing a biaxially aligned sintered magnet without adding any extra step to the powder metallurgical process. Only the magnetic field alignment/pressing apparatus typically equipped with an electromagnet or superconducting magnet must be additionally equipped with a pulsed magnetic field coil in a perpendicular direction. It is also possible to use a pulsed magnetic field for c-axis alignment. This is the only additional factor to the conventional process. The pulse coil may be disposed in a perpendicular direction to the orienting electromagnet, requiring only a minor change of the conventional magnetic field press apparatus. Since electric charging of a capacitor for generating a pulsed magnetic field may be carried out during the magnetic powder shaping/packing step, the time required for powder shaping is equivalent to the prior art process.

EXAMPLE

Examples are given below for further illustrating the invention although the invention is not limited thereto.

Examples 1 to 11

Amounts of Nd metal, electrolytic iron, ferroboron, and additive elements (inclusive of additional rare earth metals) were weighed so as to meet the composition shown in Table 1.

An alumina crucible was charged with the starting metals and placed in a high-frequency melting furnace where a NdFeB alloy was prepared. The alloy was coarsely pulverized on a jaw crusher and a Brown mill, and milled on a jet mill under such conditions as to minimize oxidation, into fine particles of NdFeB having an average particle size of 3 μm. The fine powder was packed in a press. While magnetic fields were applied from a static magnetic field coil and a pulse magnetic field coil to carry out biaxial magnetic field alignment, the powder was compacted under a pressure of 1.2 t/cm$^2$, forming a biaxially aligned compact. The static magnetic field had a strength of 1.5 T and continued for a time of 30 seconds. The perpendicular pulsed magnetic field had a peak strength of 2 T, the rise time until the peak magnetic field was 10 msec, and the pulse count was 1. The compact was sintered in Ar atmosphere at an optimum sinter temperature of around 1,100° C. for one hour and consecutively heat treated at 400-500° C. Magnetic properties of the sintered body were measured by a BH tracer, with the results shown in Table 1.

Sintered magnets having the composition of Example 8 in Table 1 were similarly prepared under the same conditions as above except that the peak strength of the perpendicular pulsed magnetic field was changed to 1 T and 3 T. Magnetic properties of these sintered magnets are also reported in Table 1 as Examples 10 and 11.

It is seen from Table 1 that even the Dy/Tb-free compositions have a coercivity Hc in excess of 1.6 MA/m. The biaxially aligned magnet of the Dy/Tb-containing composition exhibits a higher coercivity Hc. Aluminum is present in all the compositions because it is incidentally introduced from the starting ferroboron, which means that aluminum is not an essential element. X-ray diffractometry (CuKα) analysis on C-plane and an perpendicular plane of the sintered body gave a diffraction diagram in which (001) peak assigned to reflection from C-plane and (h00) peak assigned to A-plane reflection were outstanding, confirming that the 2-14-1 phase as the major phase is tetragonal and aligned in two a- and c-axes.

Comparative Examples 1 to 3

Sintered magnets having the compositions of Examples 2, 5 and 9 in Table 1 were similarly prepared under the same conditions as above except that the fine powder was subjected to uniaxial alignment along c-axis in a static magnetic field of 1.5 T as in the prior art. Magnetic properties of these sintered magnets are reported in Table 2. On X-ray diffractometry analysis, no (h00) reflection from a plane perpendicular to C-plane was observed. Apparently they exhibit lower Hc than the biaxially aligned magnets.

TABLE 1

Magnet composition and coercivity (Hcj)
Compositional formula: $(R_{1-x}R'_x)_a(Fe_{1-y-z}Al_yM_z)_bB_c$ (a, b, and c in at %)

| Example | a | b | c | R | R' | M | x | y | z | Hcj (kA/m) |
|---|---|---|---|---|---|---|---|---|---|---|
| 1 | 14.5 | 78.5 | 7 | Nd | — | Cu | 0 | 0.02 | 0.02 | 1,760 |
| 2 | 14.5 | 78.5 | 7 | Nd | — | Ga | 0 | 0.02 | 0.01 | 1,850 |
| 3 | 14.5 | 78.5 | 7 | Nd | — | Zr | 0 | 0.02 | 0.015 | 1,700 |
| 4 | 15 | 77 | 8 | Nd | — | Cu | 0 | 0.02 | 0.02 | 1,680 |
| 5 | 15 | 77 | 8 | Nd | — | Nb | 0 | 0.02 | 0.015 | 1,650 |
| 6 | 15 | 77 | 8 | Nd | — | V | 0 | 0.02 | 0.015 | 1,620 |
| 7 | 15 | 77 | 8 | Nd | — | Mo | 0 | 0.02 | 0.015 | 1,600 |
| 8 | 14 | 79.5 | 6.5 | $Nd_{0.9}Pr_{0.1}$ | — | Cu | 0 | 0.02 | 0.02 | 1,880 |
| 9 | 14 | 79.5 | 6.5 | Nd | Dy | Ga | 0.05 | 0.02 | 0.01 | 2,650 |
| 10 | 14 | 79.5 | 6.5 | $Nd_{0.9}Pr_{0.1}$ | — | Cu | 0 | 0.02 | 0.02 | 1,750 |
| 11 | 14 | 79.5 | 6.5 | $Nd_{0.9}Pr_{0.1}$ | — | Cu | 0 | 0.02 | 0.02 | 1,910 |

TABLE 2

Magnet composition and coercivity (Hcj)
Compositional formula: $(R_{1-x}R'_x)_a(Fe_{1-y-z}Al_yM_z)_bB_c$ (a, b, and c in at %)

| Comparative Example | a | b | c | R | R' | M | x | y | z | Hcj (kA/m) |
|---|---|---|---|---|---|---|---|---|---|---|
| 1 | 14.5 | 78.5 | 7 | Nd | — | Ga | 0 | 0.02 | 0.01 | 1,010 |
| 2 | 15 | 77 | 8 | Nd | — | Nb | 0 | 0.02 | 0.015 | 960 |
| 3 | 14 | 79.5 | 6.5 | Nd | Dy | Ga | 0.5 | 0.02 | 0.01 | 1,820 |

The anisotropic rare earth sintered magnet of the invention is best suited for use in motors and actuators in electronic information equipment, transportation vehicles and industrial equipment, power generators for wind power generation, and the like.

Japanese Patent Application No. 2010-243417 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. An anisotropic rare earth sintered magnet comprising a tetragonal $R_2Fe_{14}B$ compound as a major magnetic phase, wherein R is a rare earth element which is Nd or a combination of Nd with at least one member selected from the group consisting of Y, La, Ce, Pr, Sm, Eu, Gd, Ho, Er, Tm, Yb, and Lu, sintered grains of the tetragonal $R_2Fe_{14}B$ phase having two crystallographic axes, and being biaxially aligned, in which the grains are aligned in c-axis direction and in which the grains are also separately aligned in the a-axis direction.

2. The magnet of claim 1, having a composition consisting essentially of R-R'-T-M-B and incidental impurities wherein R is the same as defined in claim 1 R' is Dy and/or Tb, T is Fe or Fe and Co, M is at least one element selected from the group consisting of Ti, Nb, Al, V, Mn, Sn, Ca, Mg, Pb, Sb, Zn, Si, Zr, Cr, Ni, Cu, Ga, Mo, W, and Ta, and the contents of these elements are 10 at %≦R≦20 at %, 0 at %≦R'≦5 at %, 0 at %≦M≦15 at %, 3 at %≦B≦15 at %, with the balance of T.

3. The magnet of claim 2 wherein the content of R' is zero, and the magnet has a coercivity Hcj of at least 1.6 MA/m.

4. A method for preparing an anisotropic rare earth sintered magnet comprising a tetragonal $R_2Fe_{14}B$ compound as a major magnetic phase, wherein R a rare earth element which is Nd or a combination of Nd with at least one member selected from the group consisting of Y, La, Ce, Pr, Sm, Eu, Gd, Ho, Er, Tm, Yb, and Lu, the method comprising the steps of:

providing a magnet powder comprising a tetragonal $R_2Fe_{14}B$ compound as a major magnetic phase, grains of the tetragonal $R_2Fe_{14}B$ phase powder having two crystallographic axes, c-axis as axis of easy magnetization and a-axis as axis of hard magnetization, compacting the powder while a first static magnetic field is applied across the powder so as to align the c-axis in the magnetic field direction, and a second magnetic field substantially orthogonal to the first static magnetic field is overlappingly applied to align the a-axis, and sintering the resulting compact to form a sintered magnet in which the grains are aligned in c-axis direction and in which the grains are also separately aligned in the a-axis direction.

5. The method of claim 4 wherein the second magnetic field is a pulsed magnetic field.

6. The method of claim 4 wherein the magnet has a composition consisting essentially of R-R'-T-M-B and incidental impurities wherein R is the same as defined in claim 4, R' is Dy and/or Tb, T is Fe or Fe and Co, M is at least one element selected from the group consisting of Ti, Nb, Al, V, Mn, Sn, Ca, Mg, Pb, Sb, Zn, Si, Zr, Cr, Ni, Cu, Ga, Mo, W, and Ta, and the contents of these elements are 10 at %≦R≦20 at %, 0 at %≦R'≦5 at %, 0 at %≦M≦15 at %, 3 at %≦B≦15 at %, with the balance of T.

7. The method of claim 6 wherein the content of R' is zero, and the magnet has a coercivity Hcj of at least 1.6 MA/m.

8. The method of claim 4 wherein the first static magnetic field and the second magnetic field both have a strength of 1 to 5 T.

* * * * *